US008948672B2

(12) United States Patent
Yagi et al.

(10) Patent No.: US 8,948,672 B2
(45) Date of Patent: Feb. 3, 2015

(54) FIXING DEVICE HAVING PLURALITY OF FIXATION NIP AREAS AND IMAGE FORMING APPARTUS HAVING THE SAME

(71) Applicant: Fuji Xerox Co., Ltd., Minato-ku, Tokyo (JP)

(72) Inventors: Motoyuki Yagi, Kanagawa (JP); Shigeru Watanabe, Kanagawa (JP); Yukihiro Ichiki, Kanagawa (JP); Megumi Miyazaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 63 days.

(21) Appl. No.: 13/676,798

(22) Filed: Nov. 14, 2012

(65) Prior Publication Data

US 2013/0322936 A1 Dec. 5, 2013

(30) Foreign Application Priority Data

May 31, 2012 (JP) ..... 2012-125068

(51) Int. Cl.
*G03G 15/20* (2006.01)

(52) U.S. Cl.
CPC ..... *G03G 15/2064* (2013.01); *G03G 15/2021* (2013.01); *G03G 15/2053* (2013.01); *G03G 2215/2035* (2013.01)
USPC ..... 399/329

(58) Field of Classification Search
None
See application file for complete search history.

(56) References Cited

U.S. PATENT DOCUMENTS

| | | | | |
|---|---|---|---|---|
| 2008/0003006 | A1* | 1/2008 | Tsukamura et al. | 399/67 |
| 2008/0124146 | A1* | 5/2008 | Bae et al. | 399/329 |
| 2009/0116885 | A1* | 5/2009 | Ando | 399/329 |
| 2010/0247186 | A1* | 9/2010 | Tanaka et al. | 399/329 |

FOREIGN PATENT DOCUMENTS

| | | | |
|---|---|---|---|
| JP | 2009-276576 | A | 11/2009 |
| JP | 2011-059356 | A | 3/2011 |
| JP | 2011-170051 | A | 9/2011 |

* cited by examiner

*Primary Examiner* — Walter L Lindsay, Jr.
*Assistant Examiner* — Arlene Heredia Ocasio
(74) *Attorney, Agent, or Firm* — Sughrue Mion, PLLC

(57) ABSTRACT

A fixing device includes a rotatable body; a rotatable endless belt having inner and outer peripheral surfaces; a first presser portion within the inner peripheral surface and pressing the outer peripheral surface onto the rotatable body to form a first nip, through which a recording medium passes, between the endless belt and the rotatable body; and a second presser portion within the inner peripheral surface and pressing the outer peripheral surface onto the rotatable body to form a second nip through which the recording medium passes. The first nip decreases in length in a recording-medium transport direction from a central area toward opposite ends in an axial direction. The second nip increases in length in the transport direction from a central area toward opposite ends in the axial direction, and has an upstream edge, in the transport direction, whose central area protrudes upstream relative to the opposite ends.

2 Claims, 12 Drawing Sheets

FIXING DEVICE HAVING PLURALITY OF FIXATION NIP AREAS AND IMAGE FORMING APPARTUS HAVING THE SAME

CROSS-REFERENCE TO RELATED APPLICATIONS

This application is based on and claims priority under 35 USC 119 from Japanese Patent Application No. 2012-125068 filed May 31, 2012.

BACKGROUND

Technical Field

The present invention relates to fixing devices and image forming apparatuses.

SUMMARY

According to an aspect of the invention, there is provided a fixing device including a rotatable body, a rotatable endless belt, a first presser portion, and a second presser portion. The endless belt has an inner peripheral surface and an outer peripheral surface that is disposed facing the rotatable body. The first presser portion is provided within the inner peripheral surface of the endless belt and presses the outer peripheral surface of the endless belt onto the rotatable body in an opposed area where the endless belt and the rotatable body are opposed to each other so as to form a first fixation nip between the endless belt and the rotatable body and through which a recording medium bearing an image passes. The second presser portion is provided within the inner peripheral surface of the endless belt and presses the outer peripheral surface of the endless belt onto the rotatable body at a position, in the opposed area, downstream of the first fixation nip in a transport direction of the recording medium so as to form a second fixation nip through which the recording medium having passed through the first fixation nip passes. The first fixation nip has a shape such that a length thereof in the transport direction decreases from a central area thereof toward opposite ends thereof in an axial direction, which extends along a rotational axis of the rotatable body. The second fixation nip has a shape such that a length thereof in the transport direction increases from a central area thereof toward opposite ends thereof in the axial direction, and an upstream edge of the second fixation nip in the transport direction has a shape such that the central area in the axial direction protrudes upstream in the transport direction relative to the opposite ends in the axial direction.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below with reference to the appended drawings.

Figure 1:
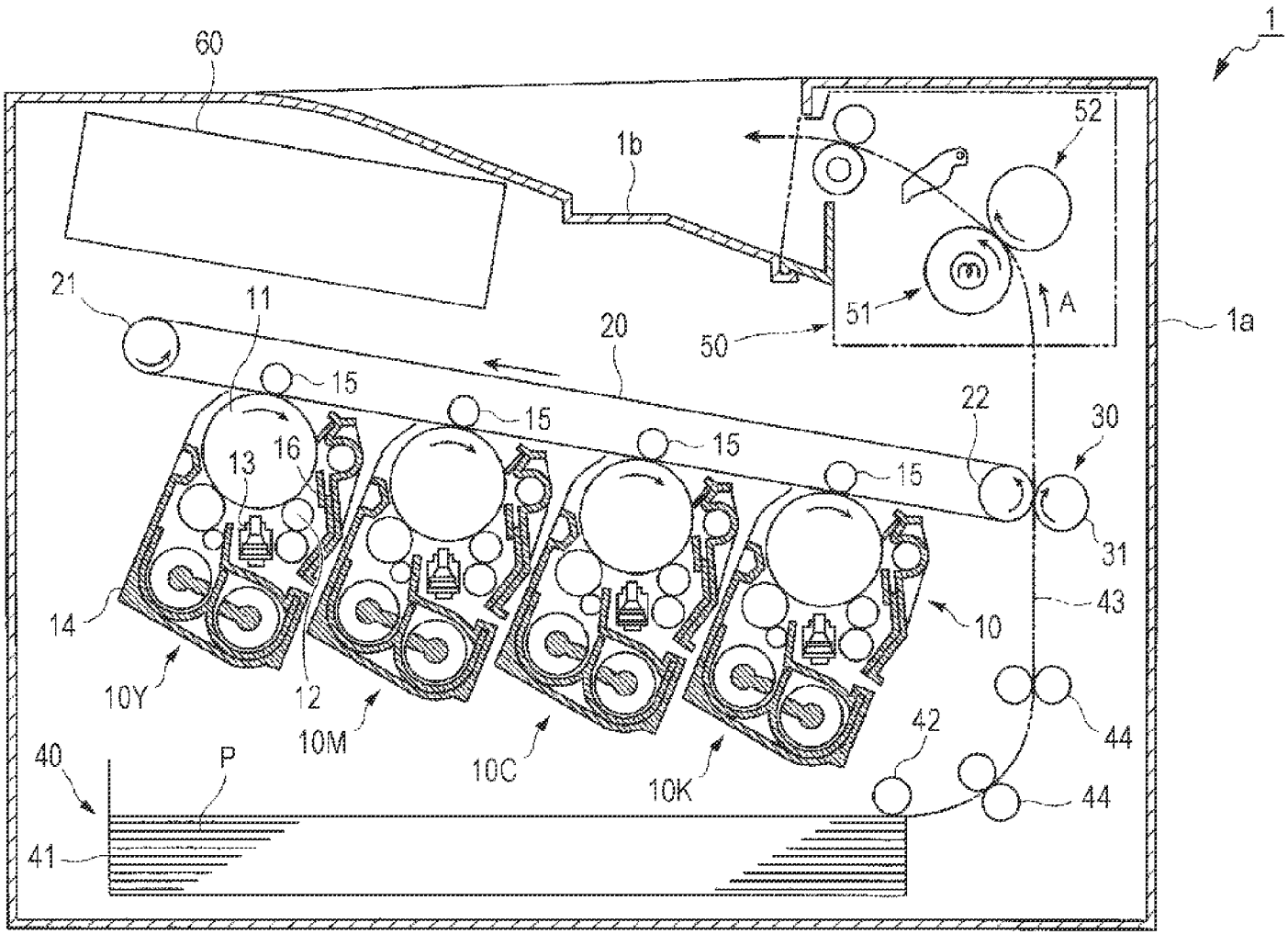
FIG. 1 illustrates an example of the overall configuration of an image forming apparatus.

FIG. 1 illustrates an example of the overall configuration of an image forming apparatus 1 according to this exemplary embodiment. FIG. 1 is a cross-sectional view of the image forming apparatus 1, as viewed from the front side thereof.

The image forming apparatus 1 includes an image forming section 10 that forms an image, an intermediate transfer belt 20 onto which the image formed by the image forming section 10 is first-transferred, a second-transfer device 30 that second-transfers the image first-transferred on the intermediate transfer belt 20 onto a sheet P, a sheet feeder 40 that feeds the sheet P as an example of a recording medium toward the second-transfer device 30, a fixing device 50 that fixes the image second-transferred on the sheet P by the second-transfer device 30 onto the sheet P, and a controller 60 that controls the operation of each component included in the image forming apparatus 1. Furthermore, the image forming apparatus 1 has an apparatus housing 1*a* that accommodates these components therein. An upper portion of the apparatus housing 1*a* is provided with an output-sheet stacker 1*b* on which the sheet P having the image fixed thereon by traveling through the fixing device 50 is stacked. In this exemplary embodiment, the fixing device 50 is attachable to and detachable from the apparatus housing 1*a* of the image forming apparatus 1.

The image forming section 10 includes multiple image forming units 10Y, 10M, 10C, and 10K that electrophotographically form toner images of different color components. The image forming units 10Y, 10M, 10C, and 10K are arranged so as to face the intermediate transfer belt 20. The image forming units 10Y, 10M, 10C, and 10K form yellow, magenta, cyan, and black images, respectively.

The image forming units 10Y, 10M, 10C, and 10K each include a photoconductor drum 11 that is attached in a rotatable manner in a direction indicated by an arrow in the drawing. In each of the image forming units 10Y, 10M, 10C, and 10K, the photoconductor drum 11 is surrounded by a charging device 12 that electrostatically charges the photoconductor drum 11, an exposure device 13 that exposes the photoconductor drum 11 to light so as to write an electrostatic latent image thereon, and a developing device 14 that develops the electrostatic latent image on the photoconductor drum 11 into a visible image by using the toner of the corresponding color. Furthermore, each of the image forming units 10Y, 10M, 10C, and 10K is also provided with a first-transfer device 15 that transfers the toner image of the corresponding color component formed on the photoconductor drum 11 onto the intermediate transfer belt 20, and a drum cleaning device 16 that removes residual toner from the photoconductor drum 11.

The intermediate transfer belt 20 is wrapped around two rotatable roller members 21 and 22 so as to rotate in a direction indicated by an arrow in the drawing. The roller member 21 is used for driving the intermediate transfer belt 20. The roller member 22 is opposed to a second-transfer roller 31 with the intermediate transfer belt 20 interposed therebetween, and the second-transfer roller 31 and the roller member 22 constitute the second-transfer device 30. A belt cleaning device (not shown) that removes residual toner from the intermediate transfer belt 20 is opposed to the roller member 21 with the intermediate transfer belt 20 interposed therebetween.

The sheet feeder 40 includes a sheet accommodating portion 41 that is disposed below the image forming section 10 and accommodates sheets P to be used in the image forming apparatus 1, a feed roller 42 that fetches and feeds a sheet P from the sheet accommodating portion 41, a transport path 43 along which the sheet P fetched by the feed roller 42 is transported, and transport rollers 44 that transport the sheet P along the transport path 43. The transport path 43 extends within the apparatus housing 1*a* from the sheet accommodating portion 41 to the output-sheet stacker 1*b* via the second-transfer device 30 and the fixing device 50.

Furthermore, the fixing device 50 includes a heating module 51 and a pressure module 52 that are opposed to each other with the transport path 43 interposed therebetween. The heating module 51 comes into contact with one face of the sheet P transported in a direction indicated by an arrow A so as to heat the sheet P. The pressure module 52 comes into contact with the other face of the sheet P so as to apply pressure to the sheet P. Specifically, the heating module 51 is disposed facing a face (i.e., one face) of the sheet P that faces the intermediate transfer belt 20 (i.e., the roller member 22) when traveling through the second-transfer device 30. On the other hand, the pressure module 52 is disposed facing a face (i.e., the other face) of the sheet P that faces the second-transfer roller 31 when traveling through the second-transfer device 30. A detailed configuration of the fixing device 50 will be described later. In the following description, the direction indicated by the arrow A will be referred to as "transport direction A".

Image forming operation performed by using the image forming apparatus 1 shown in FIG. 1 will now be described.

Upon receiving image information from an external device (not shown), the controller 60 generates exposure data based on the image information and outputs the exposure data to the exposure devices 13 in the image forming section 10, and also outputs an operation-start control signal to the components constituting the image forming apparatus 1.

For example, in the yellow (Y) image forming unit 10Y, the photoconductor drum 11 rotationally driven in the direction of the arrow is electrostatically charged by the charging device 12 and is exposed to light emitted from the exposure device 13 on the basis of the exposure data supplied from the controller 60. Thus, an electrostatic latent image related to a yellow image is formed on the photoconductor drum 11. Then, the electrostatic latent image formed on the photoconductor drum 11 is developed by the developing device 14, whereby a yellow toner image is formed on the photoconductor drum 11. Likewise, in the remaining image forming units 10M, 10C, and 10K, magenta (M), cyan (C), and black (K) toner images are respectively formed based on the above-described procedure.

The toner images formed on the photoconductor drums 11 of the image forming units 10Y, 10M, 10C, and 10K are first-transferred (electrostatically-transferred) by the respective first-transfer devices 15 onto the intermediate transfer belt 20 rotationally driven in the direction of the arrow, and are superposed on the intermediate transfer belt 20. Then, as the intermediate transfer belt 20 rotates, the superposed toner image on the intermediate transfer belt 20 is transported toward a second-transfer position where the second-transfer device 30 is provided. The residual toners remaining on the photoconductor drums 11 after the first-transfer process are removed by the drum cleaning devices 16 provided in the image forming units 10Y, 10M, 10C, and 10K.

In the sheet feeder 40, the sheets P accommodated in the sheet accommodating portion 41 are fetched one-by-one by using the feed roller 42 so as to be fed to the transport path 43. Subsequently, the transport rollers 44 provided along the transport path 43 transport each sheet P transported from the sheet accommodating portion 41 to the second-transfer position in synchronization with a timing at which the superposed toner image on the intermediate transfer belt 20 reaches the second-transfer position.

Then, the superposed toner image on the intermediate transfer belt 20 is second-transferred (electrostatically-transferred) by the second-transfer device 30 onto the sheet P passing through the second-transfer position. In this case, the superposed toner image is second-transferred onto the face of the sheet P that faces the intermediate transfer belt 20.

Subsequently, the sheet P having the superposed toner image transferred thereon by passing through the second-transfer position travels through the fixing device 50. In this case, the face of the sheet P having the superposed toner image thereon is heated by the heating module 51, and the sheet P is pressed by the heating module 51 and the pressure module 52, whereby the superposed toner image is fixed onto the sheet P. Then, the sheet P having the superposed toner image fixed thereon by traveling through the fixing device 50 is output to the output-sheet stacker 1*b*. The residual toner remaining on the intermediate transfer belt 20 after passing through the second-transfer position is removed by the belt cleaning device (not shown).

Next, the configuration of the fixing device 50 provided in the image forming apparatus 1 will be described below in more detail.

Figure 2:
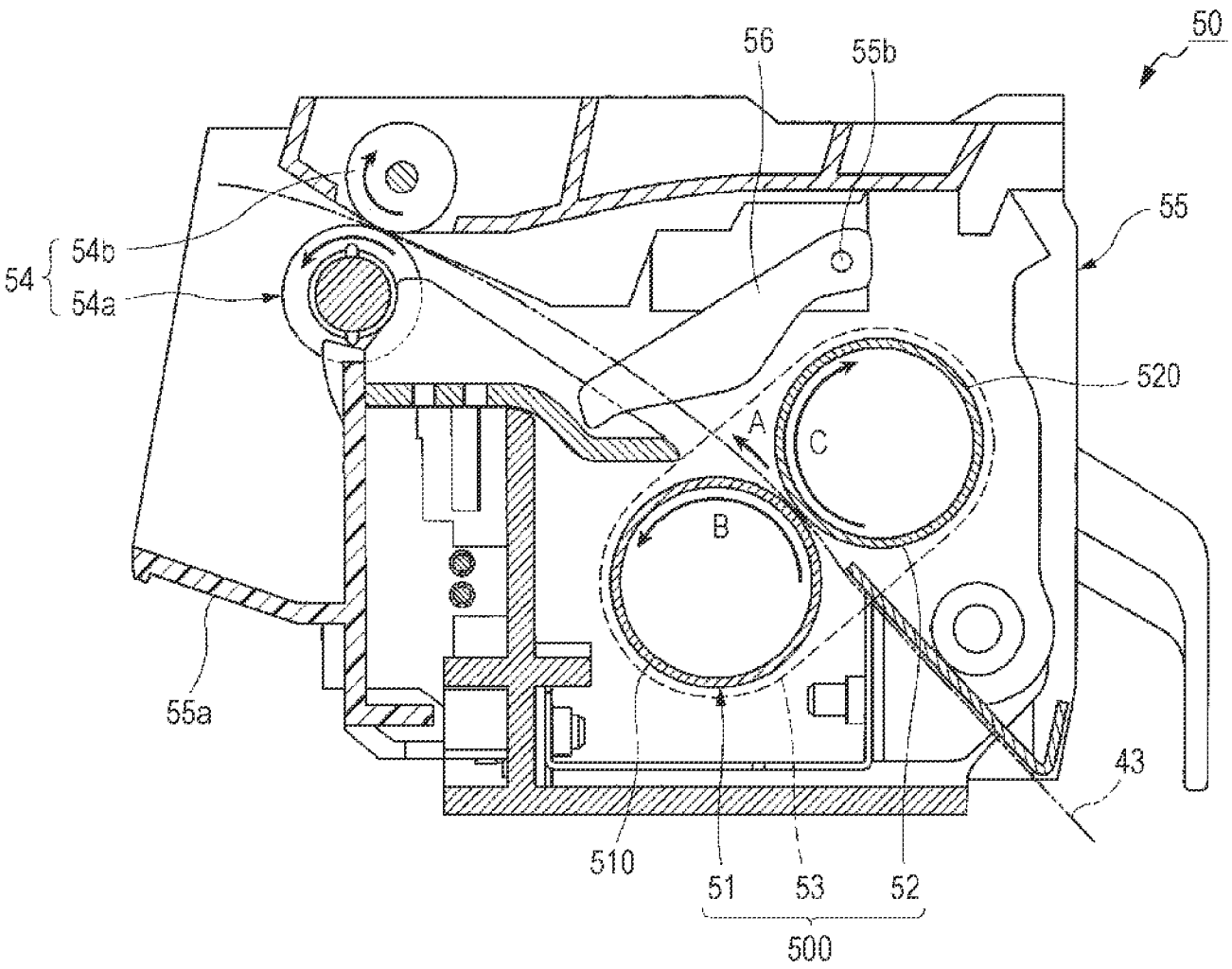
FIG. 2 is a cross-sectional view illustrating the overall configuration of a fixing device in the image forming apparatus.

FIG. 2 is a cross-sectional view illustrating the overall configuration of the fixing device 50 in the image forming apparatus 1 shown in FIG. 1. Specifically, FIG. 2 illustrates the structure of the fixing device 50, as viewed from the front side thereof (i.e., from the near side in FIG. 1).

The fixing device 50 according to this exemplary embodiment includes the aforementioned heating module 51; the aforementioned pressure module 52; a support module 53 that integrally supports the heating module 51 and the pressure module 52; output rollers 54 that are disposed with the transport path 43 interposed therebetween at a position downstream, in the transport direction A of the sheet P, of an opposed area between the heating module 51 and the pressure module 52 and that output the sheet P onto the output-sheet stacker 1*b* (see FIG. 1) after the fixing process; a fixation housing 55 that accommodates the aforementioned modules and the output rollers 54 therein; and a detecting piece 56 that is provided in the transport path 43 at a position downstream, in the transport direction A, of the opposed area between the heating module 51 and the pressure module 52 and upstream, in the transport direction A, of the output rollers 54 and is used for detecting the passing of the sheet P. In this exemplary embodiment, the heating module 51, the pressure module 52, and the support module 53 described above constitute an integrated fixing unit 500.

The heating module 51 includes a heating roller 510 as an example of a rotatable body that is disposed below the transport path 43 and rotates in a direction indicated by an arrow B, which is substantially parallel to the transport direction A, in an area facing the transport path 43. The pressure module 52 includes a pressure belt 520 as an example of an endless belt that is disposed in an area above the transport path 43 and facing the heating roller 510 and that rotates in a direction indicated by an arrow C, which is substantially parallel to the transport direction A, in an area facing the transport path 43 (i.e., the heating roller 510). A specific configuration of the fixing unit 500 will be described later. In the following description, the direction of the arrow B described above will be referred to as "roller rotating direction B", and the direction of the arrow C described above will be referred to as "belt rotating direction C".

The output rollers 54 according to this exemplary embodiment include a driving roller 54*a* disposed below the transport path 43 and rotationally driven by a driving source (not shown), and a driven roller 54*b* disposed above the transport path 43 and in contact with the driving roller 54*a* and is rotated by the rotation of the driving roller 54*a*.

A tabular protrusion 55*a* that forms the output-sheet stacker 1*b* together with the apparatus housing 1*a* when the fixing device 50 is attached to the image forming apparatus 1 shown in FIG. 1 protrudes outward and sideways from an area below the positions of the fixation housing 55 to which the output rollers 54 are attached. Furthermore, a support shaft 55*b* extending through a hole provided in the detecting piece 56 so as to rotatably support the detecting piece 56 is provided above the transport path 43 inside the fixation housing 55.

As described above, the detecting piece 56 is rotatably attached to the support shaft 55*b* provided in the fixation housing 55 and is biased in the counterclockwise direction by a spring (not shown). In a normal state, the detecting piece 56 is positioned so as to block the transport path 43. When the sheet P travels in the transport direction A through this area, the detecting piece 56 is pushed by the sheet P so as to rotate in the clockwise direction, thereby detecting the passing of the sheet P.

Figure 3:
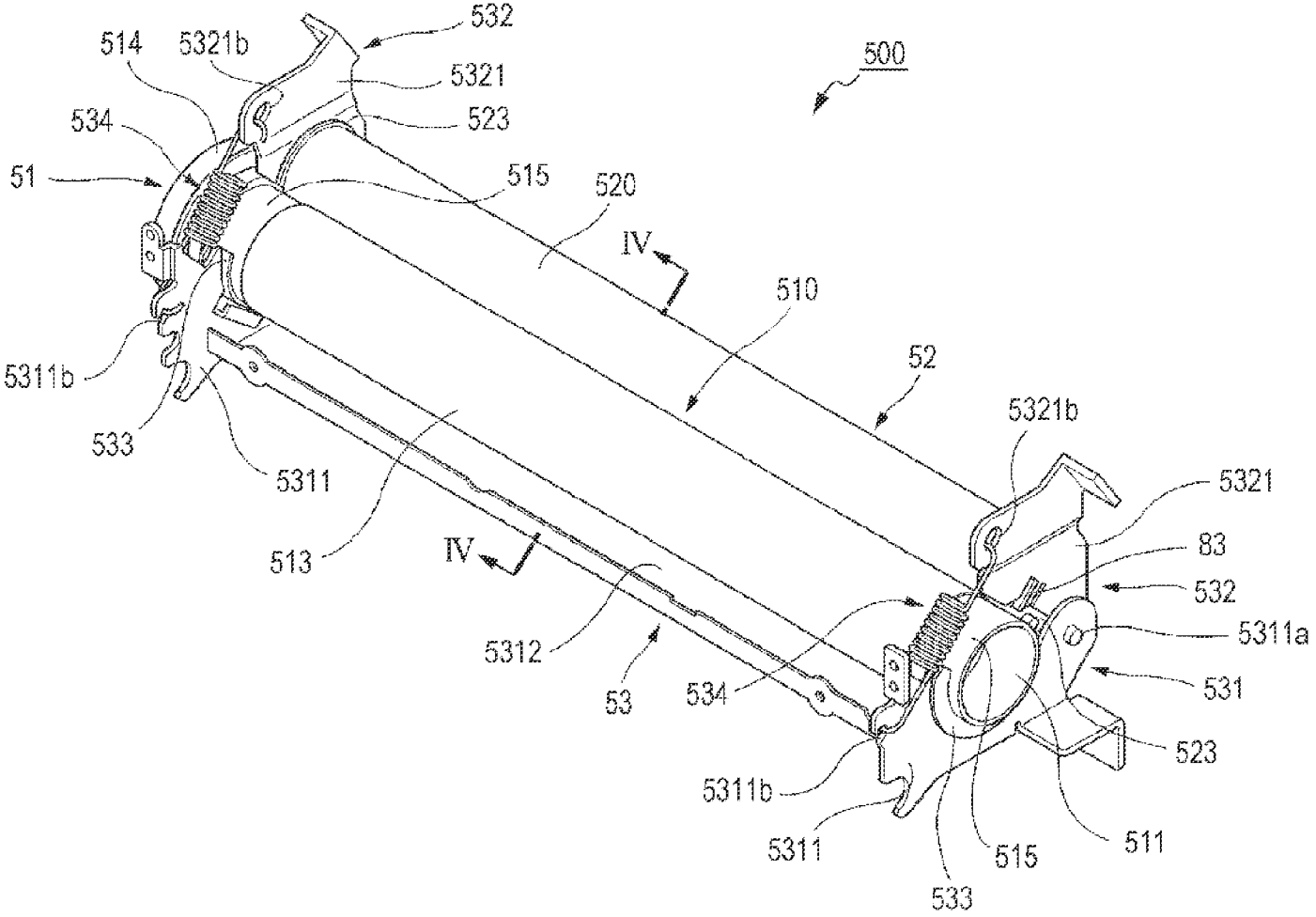
FIG. 3 is a perspective view illustrating the overall configuration of a fixing unit in the fixing device.
Figure 4:
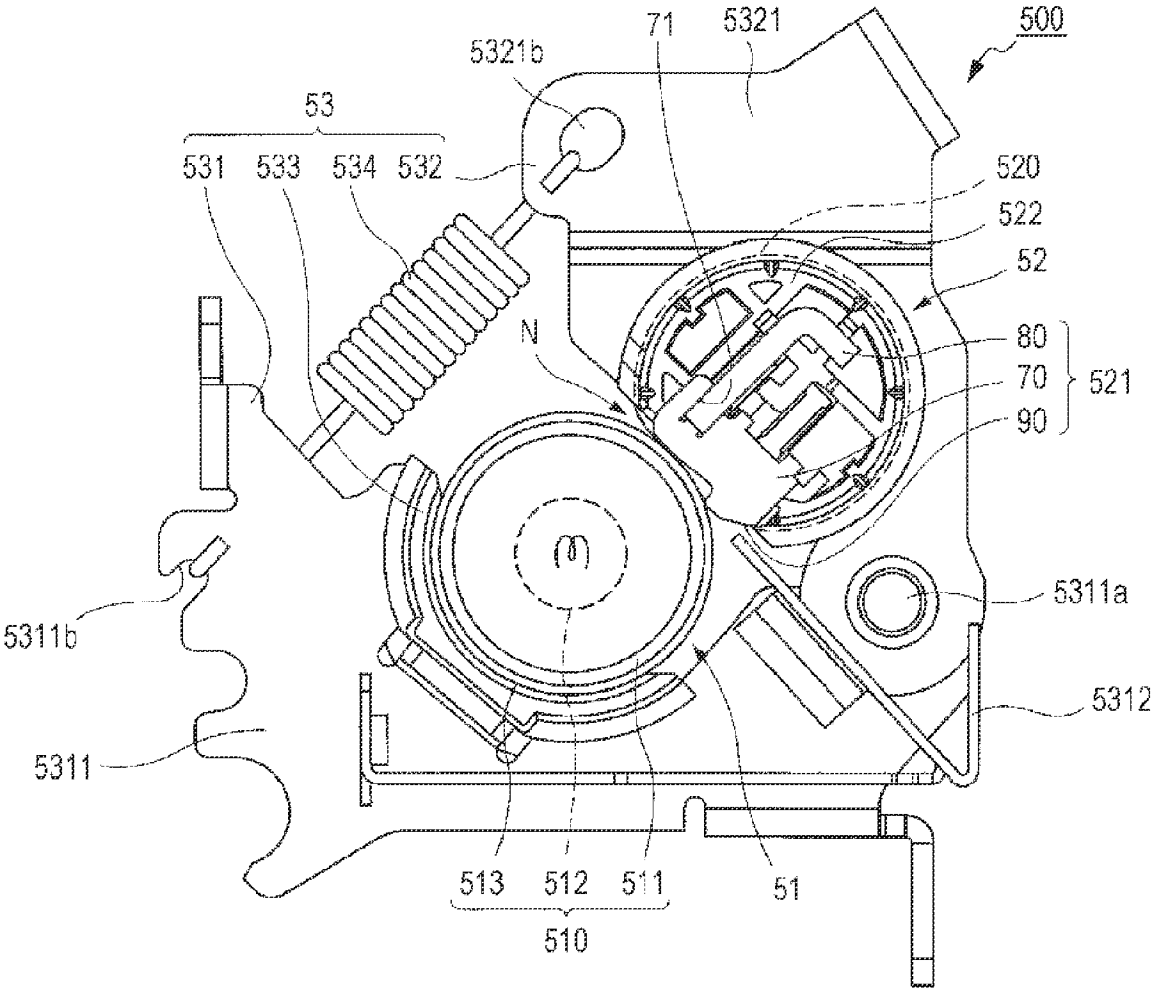
FIG. 4 is a cross-sectional view of the fixing unit.
Figure 5:
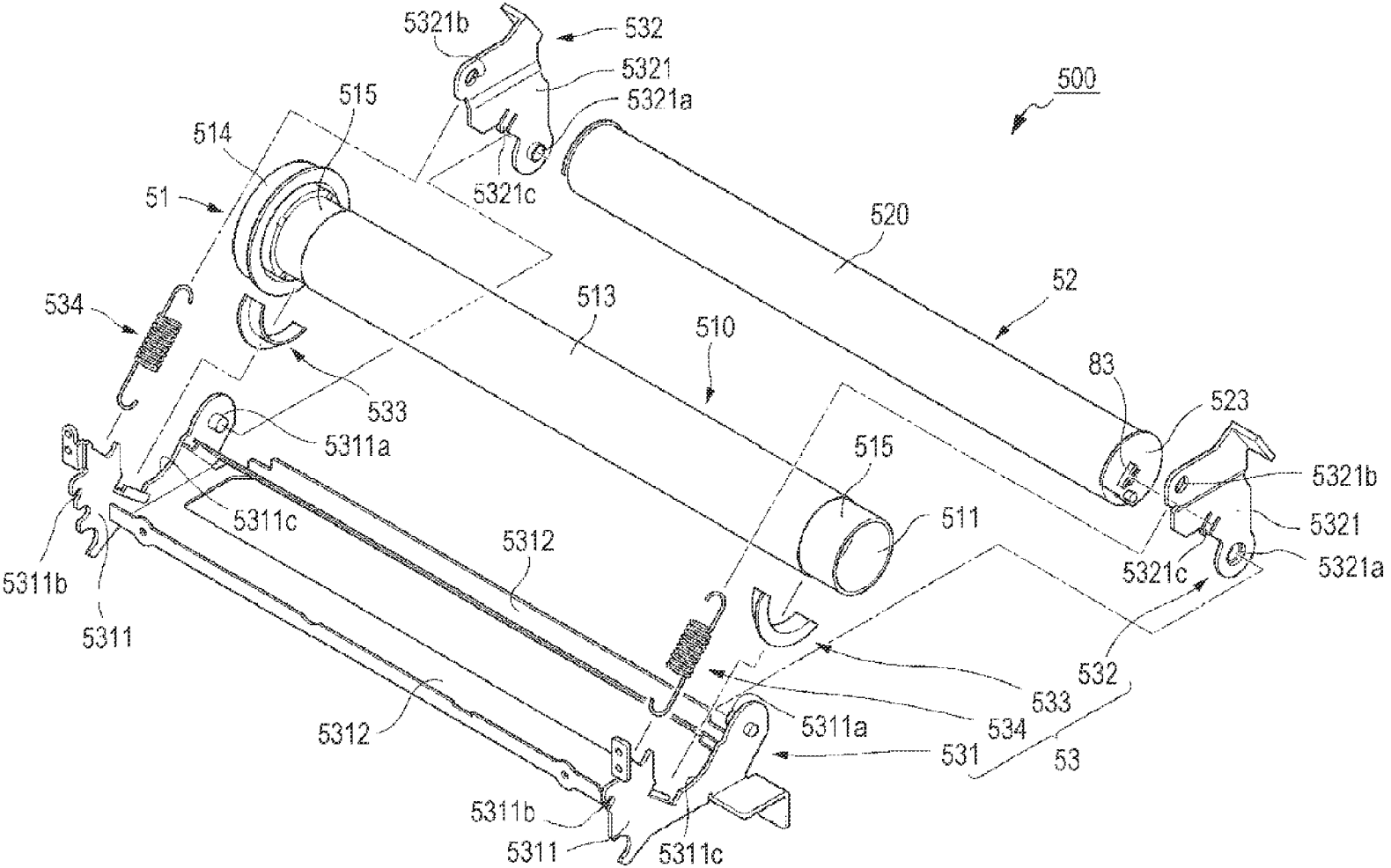
FIG. 5 is an exploded perspective view of the fixing unit.
Figure 6:
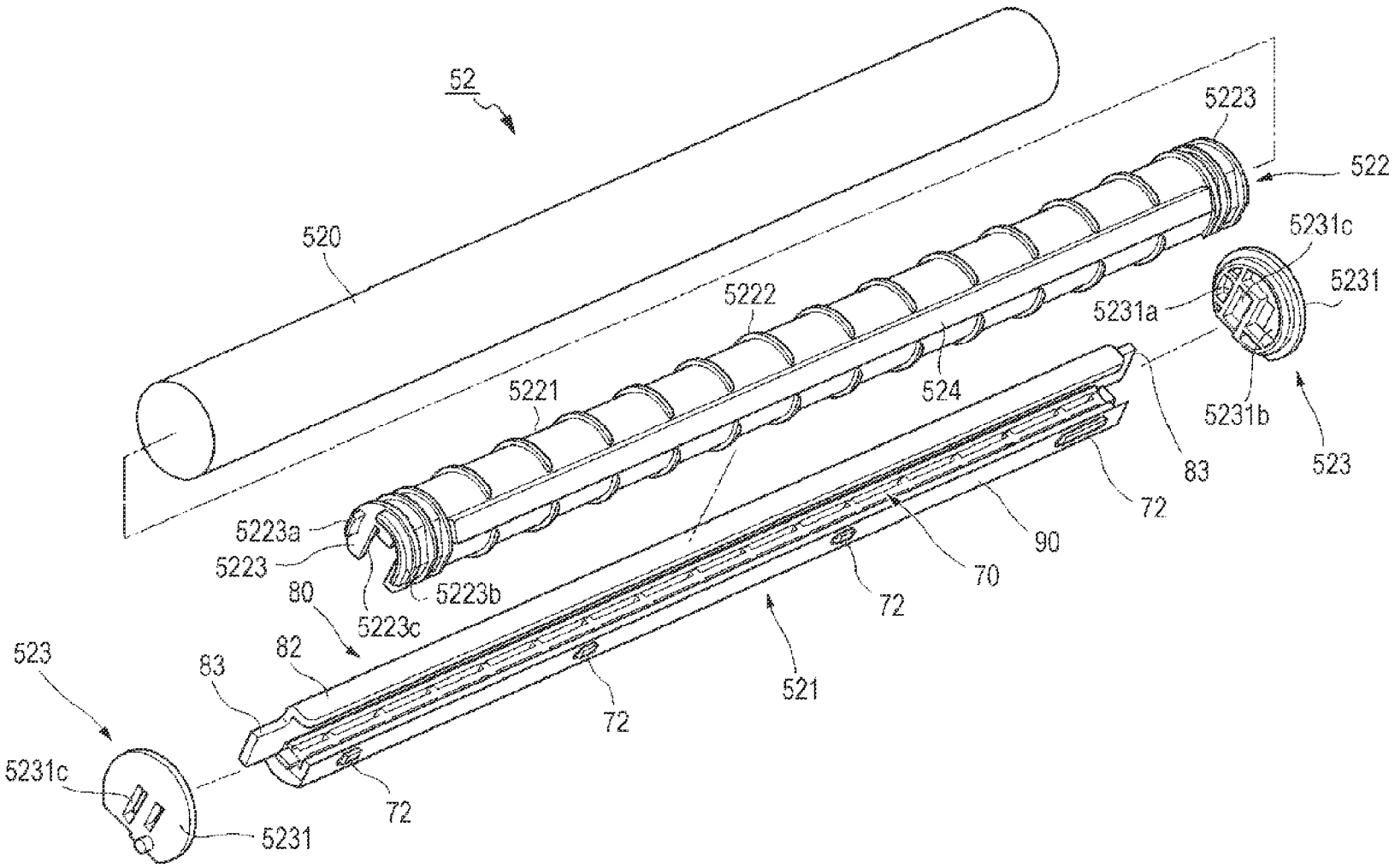
FIG. 6 is an exploded perspective view of a pressure module in the fixing unit.
Figure 7:
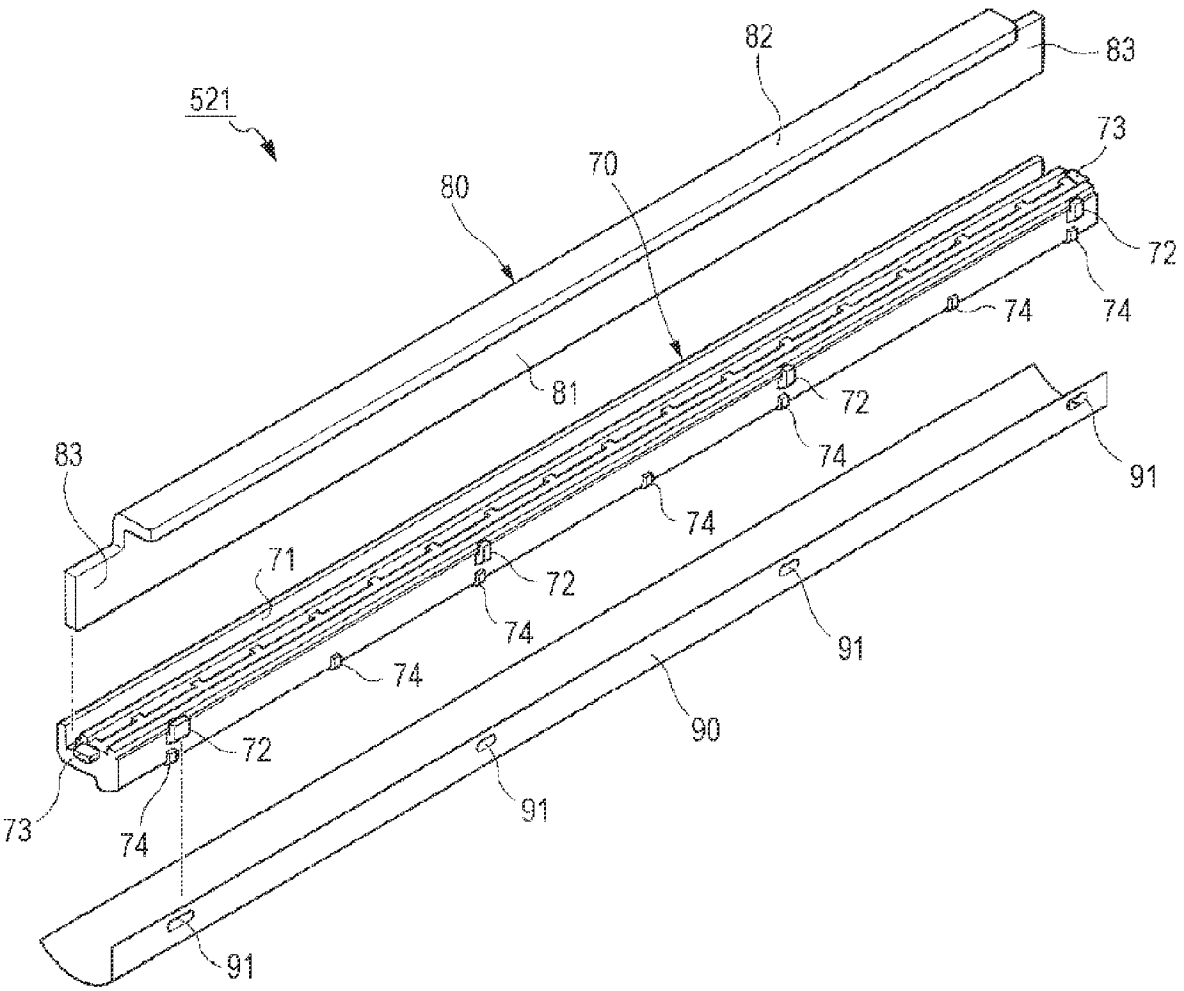
FIG. 7 is an exploded perspective view of a pressure member in the pressure module.

FIG. 3 is a perspective view illustrating the overall configuration of the fixing unit 500 in the fixing device 50. FIG. 4 is a cross-sectional view of the fixing unit 500 shown in FIG. 3, taken along line IV-IV in FIG. 3. FIG. 5 is an exploded perspective view of the fixing unit 500 shown in FIG. 3. FIG. 6 is an exploded perspective view of the pressure module 52 in the fixing unit 500. FIG. 7 is an exploded perspective view of a pressure member 521 (to be described in detail later) in the pressure module 52.

In FIGS. 3 and 5, the lower right side is the front side when the fixing unit 500 is attached to the image forming apparatus 1, and the upper left side is the rear side when the fixing unit 500 is attached to the image forming apparatus 1. FIG. 4 is a cross-sectional view of the rear side, as viewed from the front side. In FIGS. 6 and 7, the lower left side is the front side when the fixing unit 500 is attached to the image forming apparatus 1, and the upper right side is the rear side when the fixing unit 500 is attached to the image forming apparatus 1.

As described above, the fixing unit 500 according to this exemplary embodiment includes the heating module 51, the pressure module 52, and the support module 53. In this exemplary embodiment, the heating roller 510 provided in the heating module 51 and the pressure belt 520 provided in the pressure module 52 are supported by the support module 53 such that the heating roller 510 and the pressure belt 520 are in contact with each other at the opposed area, thereby forming a fixation nip N through which the sheet P passes. The support module 53 supporting the heating module 51 and the pressure module 52 is attached to the fixation housing 55 shown in FIG. 2.

The heating module 51 according to this exemplary embodiment includes the heating roller 510 that has the shape of a roller and comes into contact with the sheet P passing through the fixation nip N so as to heat the sheet P.

The heating roller 510 includes a cylindrical member 511, a heater element 512 that is disposed within an inner peripheral surface of the cylindrical member 511 and generates heat by being supplied with electricity, a cover member 513 that covers an area of an outer peripheral surface of the cylindrical member 511 excluding the opposite axial ends thereof, and a gear 514 that is securely attached to the far end of the outer peripheral surface of the cylindrical member 511, that is, the area of the cylindrical member 511 not covered by the cover member 513. In the heating roller 510, the opposite axial ends of the cylindrical member 511 are provided with exposed portions 515 where the outer peripheral surface of the cylindrical member 511 is exposed by not being covered with the cover member 513. In the exploded perspective view shown in FIG. 5, the heater element 512 is not shown.

The cylindrical member 511 is formed of a pipe composed of metal, such as aluminum or stainless steel. The heater element 512 is formed of, for example, a halogen lamp. The cover member 513 is composed of a heat-resistant, elastic material, such as rubber. Alternatively, the cover member 513 may have a multilayer structure constituted of an elastic layer (such as a rubber layer) formed over the outer peripheral surface of the cylindrical member 511, and a mold-release layer (such as a fluorine-based resin layer) formed over the elastic layer. When the fixing device 50 is attached to the image forming apparatus 1 shown in FIG. 1, the gear 514 meshes with a gear (not shown) provided at the rear side of the apparatus housing 1*a* so as to receive a driving force from the apparatus housing 1*a*, thereby rotating the heating roller 510 in the roller rotating direction B.

The pressure module 52 according to this exemplary embodiment includes the pressure belt 520 that has the shape of an endless belt and applies pressure to the sheet P passing through the fixation nip N by nipping the sheet P together with the heating roller 510; the pressure member 521 that is disposed within the inner peripheral surface of the pressure belt 520 and presses the pressure belt 520 toward the heating roller 510; a belt support member 522 that is disposed within the inner peripheral surface of the pressure belt 520 and rotatably supports the pressure belt 520 while maintaining the pressure member 521 in a fixed state; and restricting members 523 that are attached to the belt support member 522 at the outer sides of the opposite axial ends of the pressure belt 520 and restrict meandering of the pressure belt 520 rotating in the belt rotating direction C. The restricting members 523 are attached to the opposite axial ends of the belt support member 522. Furthermore, the pressure module 52 also includes a lubricant supplying member 524 that is securely attached to the belt support member 522 at a position facing the inner peripheral surface of the pressure belt 520 and comes into contact with the inner peripheral surface of the pressure belt 520 so as to supply a lubricant to the inner peripheral surface of the pressure belt 520.

The pressure belt 520 is formed by coating a thin, cylindrical belt backing material composed of synthetic resin, such as polyimide, with a mold-release layer composed of fluorine-based resin.

The pressure member 521 includes a presser component 70 that is disposed within the pressure belt 520 in an area facing the heating roller 510 with the pressure belt 520 interposed therebetween and presses the pressure belt 520 toward the heating roller 510 via the inner peripheral surface of the pressure belt 520 so as to form the fixation nip N; a presser support component 80 that is attached to the back surface of the presser component 70, as viewed from the fixation nip N, so as to support the presser component 70 within the pressure belt 520 and that is also attached to the belt support member 522 via the restricting members 523; and a film component 90 that is attached to the presser component 70 within the pressure belt 520 and is disposed so as to extend between the inner peripheral surface of the pressure belt 520 and the presser component 70 at the fixation nip N.

The presser component 70 constituting the pressure member 521 has an opposing surface (which will be described in detail later) that is to face the pressure belt 520, and is provided with a groove 71 behind the opposing surface. The groove 71 is provided for fitting the presser support component 80 thereto and extends in the axial direction. Furthermore, the presser component 70 includes four hooks 72 that are arranged in the axial direction on an upstream side surface of the presser component 70 in the transport direction A and are used for attaching the film component 90 thereto. Moreover, the presser component 70 also includes two protrusions 73 that protrude outward in the axial direction respectively from the opposite axial ends of the presser component 70. The presser component 70 also includes seven ribs 74 that protrude from the opposing surface to the same plane as the four hooks 72. The presser component 70 according to this exemplary embodiment is formed by, for example, integrally molding heat-resistant synthetic resin. The hardness of the presser component 70 is lower than that of the cylindrical member 511 in the heating roller 510 but is higher than that of the cover member 513 in the heating roller 510.

The presser support component 80 constituting the pressure member 521 has a tabular presser portion 81 whose one edge is fitted into the groove 71 in the presser component 70, and a bent portion 82 that is integrated with the presser portion 81 and is set in a 90° bent state, as viewed from the presser portion 81. The opposite axial ends of the presser portion 81 are respectively located at the outer sides of the opposite axial ends of the bent portion 82, such that these two protruding ends of the presser portion 81 serve as protrusions 83. The presser support component 80 according to this exemplary embodiment is formed by performing various kinds of processes on a single metal plate composed of stainless steel or the like.

The film component 90 constituting the pressure member 521 is provided with four rectangular openings 91 arranged at one side thereof at positions corresponding to the four hooks 72 provided on the presser component 70. The four hooks 72 are respectively engaged with the four openings 91. The film component 90 according to this exemplary embodiment is composed of fluorine-based resin, which has high heat resisting properties and a low friction coefficient.

Furthermore, the belt support member 522 includes a support body 5221 extending in the axial direction that intersects the belt rotating direction C of the pressure belt 520 and having a U-shape in cross section by having an opening oriented toward the heating roller 510, multiple ribs 5222 arranged in the axial direction on the outer peripheral surface of the support body 5221 and extending in the belt rotating direction C, and sidewalls 5223 provided at the opposite axial ends of the support body 5221. Of the multiple ribs 5222 provided on the belt support member 522, multiple ribs 5222 provided in an intermediate area of the support body 5221 in the axial direction are provided with cutouts for attaching the lubricant supplying member 524 thereto.

The two sidewalls 5223 of the belt support member 522 are each provided with a first projection 5223*a* and a second projection 5223*b* that protrude outward in the axial direction. Moreover, each of the two sidewalls 5223 is provided with a cutout 5223*c* that is oriented in the same direction as the opening provided in the outer peripheral surface of the support body 5221. The belt support member 522 according to this exemplary embodiment is formed by, for example, integrally molding heat-resistant synthetic resin.

The two restricting members 523 each include a circular restricting body 5231 whose one end is linearly cut out. Each restricting body 5231 has a first recess 5231*a* and a second recess 5231*b* provided in a side surface thereof that faces the pressure member 521, and a rectangular through-hole 5231*c* extending through the restricting body 5231.

The lubricant supplying member 524 has a rectangular-parallelepiped shape and is attached to an area where the ribs 5222 are not provided on the outer peripheral surface of the support body 5221 of the belt support member 522 so as to extend in the axial direction. The lubricant supplying member 524 is formed of, for example, a sponge or felt material and is impregnated with lubricating oil as a lubricant.

The support module 53 according to this exemplary embodiment includes a roller support member 531 that supports the heating module 51 including the heating roller 510; a belt support member 532 that is rotatably attached to the roller support member 531 and supports the pressure module 52 including the pressure belt 520; two plain bearings 533 that are attached to the roller support member 531 and rotatably support the opposite axial ends of the heating roller 510 of the heating module 51; and two tension springs 534 that are attached between the roller support member 531 and the belt support member 532 at the opposite axial ends of the heating roller 510 and the pressure belt 520 and apply a force for forming the fixation nip N between the heating roller 510 of the heating module 51 and the pressure belt 520 of the pressure module 52 via the roller support member 531 and the belt support member 532.

The roller support member 531 includes two side plates 5311 respectively provided at the opposite axial ends of the heating roller 510, and two connecting plates 5312 that extend in the axial direction of the heating roller 510 and connect the two side plates 5311. The two side plates 5311 are provided with shaft portions 5311*a* for attaching the belt support member 532 thereto, spring attachment portions 5311*b* for attaching first ends of the tension springs 534 thereto, and bearing attachment portions 5311*c* for attaching the plain bearings 533 thereto. In this exemplary embodiment, an area of each connecting plate 5312 functions as a guide for guiding the sheet P transported from the upstream side of the fixation nip N in the transport direction A toward the fixation nip N (see FIG. 4).

The belt support member 532 includes two side plates 5321 that are provided in correspondence with the two side plates 5311 of the roller support member 531. The two side plates 5321 are provided with shaft attachment holes 5321a in which the shaft portions 5311*a* provided on the roller support member 531 are rotatably fitted, spring attachment holes 5321*b* for attaching second ends of the tension springs 534 thereto, and engagement portions 5321*c* that are engaged with the protrusions 83 provided in the presser support component 80 of the pressure member 521 in the pressure module 52.

The two plain bearings 533 are respectively fitted to the two bearing attachment portions 5311*c* of the roller support member 531, and respectively come into contact with the two exposed portions 515 of the heating roller 510.

Furthermore, regarding the tension springs 534, the first ends thereof are attached to the spring attachment portions 5311*b* provided in the roller support member 531, and the second ends thereof are attached to the spring attachment holes 5321*b* provided in the belt support member 532.

An assembly structure of the fixing unit 500 described above will now be described.

First, the heating roller 510 constituting the heating module 51 is formed by inserting the heater element 512 into the cylindrical member 511 provided with the cover member 513 around the outer peripheral surface thereof and having the exposed portions 515, and then fixing the gear 514 to the outer peripheral surface at one axial end (i.e., far end) of the cylindrical member 511.

In the pressure module 52, the pressure member 521 is formed by fitting one edge of the presser portion 81 of the presser support component 80 into the groove 71 provided in the presser component 70, and engaging the four openings 91 provided in the film component 90 respectively with the four hooks 72 provided on the presser component 70. Then, the pressure member 521 is inserted into the belt support member 522 through the opening provided in the support body 5221 of the belt support member 522. Consequently, the opposing surface of the presser component 70 of the pressure member 521 is positioned in the opening of the support body 5221. In this case, the protrusions 83 provided in the presser portion 81 of the pressure member 521 protrude outward relative to the sidewalls 5223 of the belt support member 522. Moreover, the lubricant supplying member 524 is attached to the outer peripheral surface of the support body 5221 so as to extend in the axial direction.

Furthermore, in the pressure module 52, the belt support member 522 accommodating the pressure member 521 therein and having the lubricant supplying member 524 attached to the outside thereof is inserted into the pressure belt 520. In this case, the multiple ribs 5222 provided on the outer peripheral surface of the belt support member 522 and the lubricant supplying member 524 attached to the outer peripheral surface of the belt support member 522 both face the inner peripheral surface of the pressure belt 520.

Furthermore, in the pressure module 52, the restricting members 523 are respectively attached to the opposite axial ends of the belt support member 522 that is inserted in the pressure belt 520 as well as accommodating the pressure member 521 therein and having the lubricant supplying member 524 attached to the outside thereof. In this case, the first recesses 5231*a* and the second recesses 5231*b* in the restricting members 523 are respectively engaged with the first projections 5223*a* and the second projections 5223*b* provided at the opposite axial ends of the belt support member 522. The diameter of each restricting member 523 is larger than that of the belt support member 522 to be attached thereto. Therefore, at the opposite axial ends of the belt support member 522, the edges of the restricting members 523 protrude from the outer peripheral surface of the belt support member 522. These protruding edges face the opposite axial ends of the pressure belt 520 so as to restrict meandering of the pressure belt 520 when it rotates. The protrusions 83 provided at the opposite axial ends of the presser support component 80 of the pressure member 521 extend through and engage with the through-holes 5231*c* provided in the restricting bodies 5231 via the cutouts 5223*c* provided in the sidewalls 5223 of the belt support member 522.

Accordingly, in this exemplary embodiment, the pressure belt 520, the pressure member 521, and the belt support member 522 having the lubricant supplying member 524 attached thereto are combined with each other via the two restricting members 523 so as to constitute the pressure module 52. Moreover, the protrusions 83 provided in the presser support component 80 of the pressure member 521 protrude outward from the opposite axial ends of the pressure module 52.

On the other hand, in the support module 53, the shaft portions 5311*a* provided on the two side plates 5311 of the roller support member 531 are engaged with the shaft attachment holes 5321*a* provided in the two side plates 5321 constituting the belt support member 532. Moreover, the engagement portions 5321*c* provided in the two side plates 5321 constituting the belt support member 532 are engaged with the protrusions 83 protruding from the opposite axial ends of the pressure module 52. Consequently, the pressure module 52 is supported by the two side plates 5321 constituting the belt support member 532 and is also rotatably supported by the roller support member 531 via these two side plates 5321.

In the support module 53, the plain bearings 533 are respectively attached to the bearing attachment portions 5311*c* provided in the two side plates 5311 of the roller support member 531. Moreover, of the two plain bearings 533, the plain bearing 533 provided at the front side supports an area of the exposed portion 515 provided at the front side of the heating roller 510, and the plain bearing 533 provided at the rear side supports an area of the exposed portion 515 provided at the rear side of the heating roller 510. As a result, the heating roller 510 is rotatably supported by the roller support member 531 via the two plain bearings 533.

Furthermore, in the support module 53, one end of the tension spring 534 provided at the front side is attached to the spring attachment portion 5311*b* of the side plate 5311 provided at the front side of the roller support member 531, whereas the other end is attached to the spring attachment hole 5321*b* of the side plate 5321 provided at the front side of the belt support member 532. On the other hand, in the support module 53, one end of the tension spring 534 provided at the rear side is attached to the spring attachment portion 5311*b* of the side plate 5311 provided at the rear side of the roller support member 531, whereas the other end is attached to the spring attachment hole 5321*b* of the side plate 5321 provided at the rear side of the belt support member 532.

As a result, the heating module 51 supported by the roller support member 531 and the pressure module 52 supported by the belt support member 532 are pressed by the two tension springs 534 in the direction in which the heating roller 510 provided in the heating module 51 and the pressure belt 520 provided in the pressure module 52 come into contact with each other, about the connection area between the two shaft portions 5311*a* provided on the roller support member 531 and the two shaft attachment holes 5321*a* provided in the belt support member 532. In this case, the presser component 70 provided in the pressure module 52 presses the heating roller 510 provided in the heating module 51 via the pressure belt 520 provided in the pressure module 52. Thus, the fixation nip N is formed between the heating roller 510 provided in the heating module 51 and the pressure belt 520 provided in the pressure module 52 due to the two coming into contact with each other.

Next, the configuration of the presser component 70 provided in the pressure member 521 of the pressure module 52 described above will be described below in detail.

Figure 8:
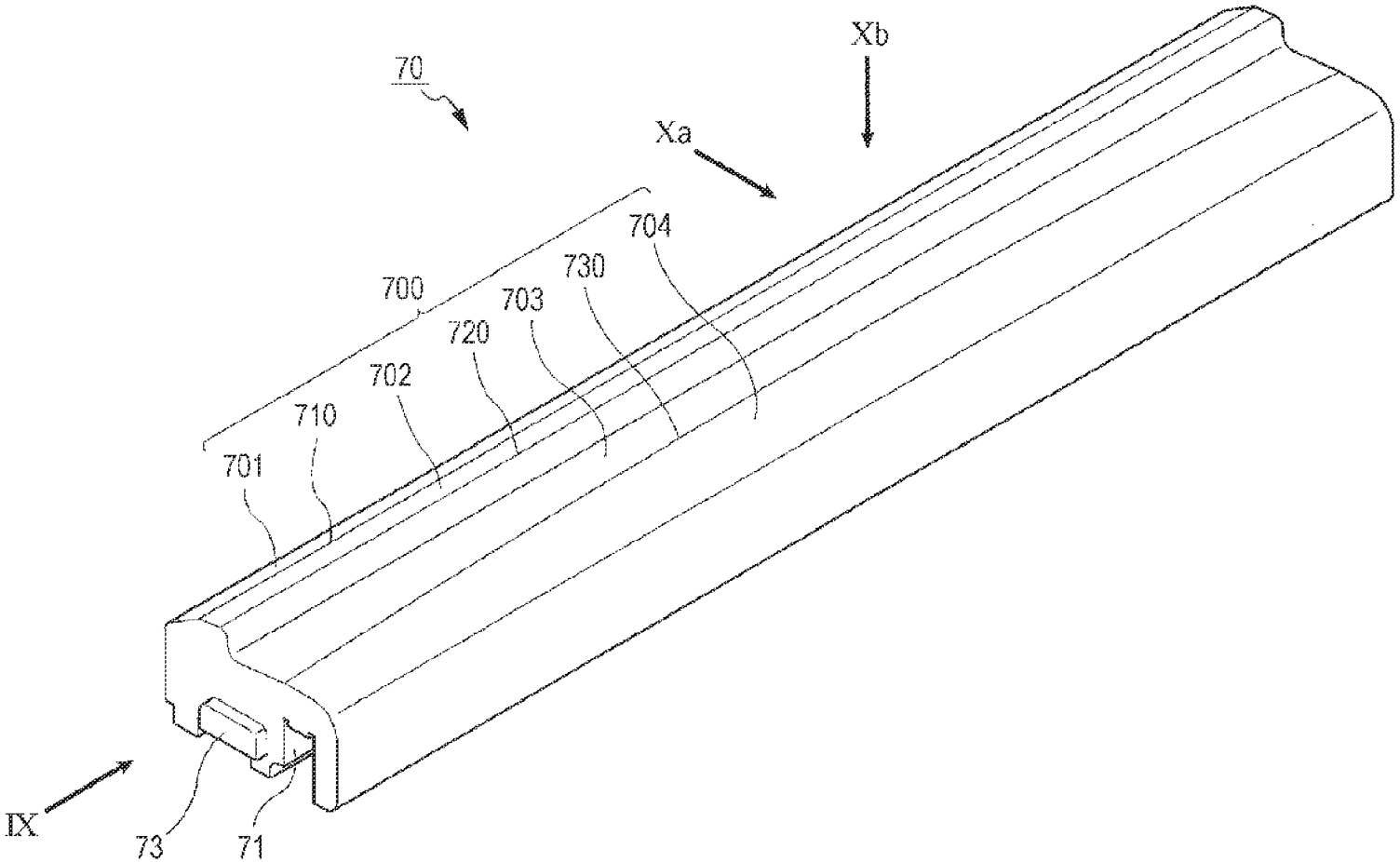
FIG. 8 is a perspective view of a presser component of the pressure member.
Figure 9:
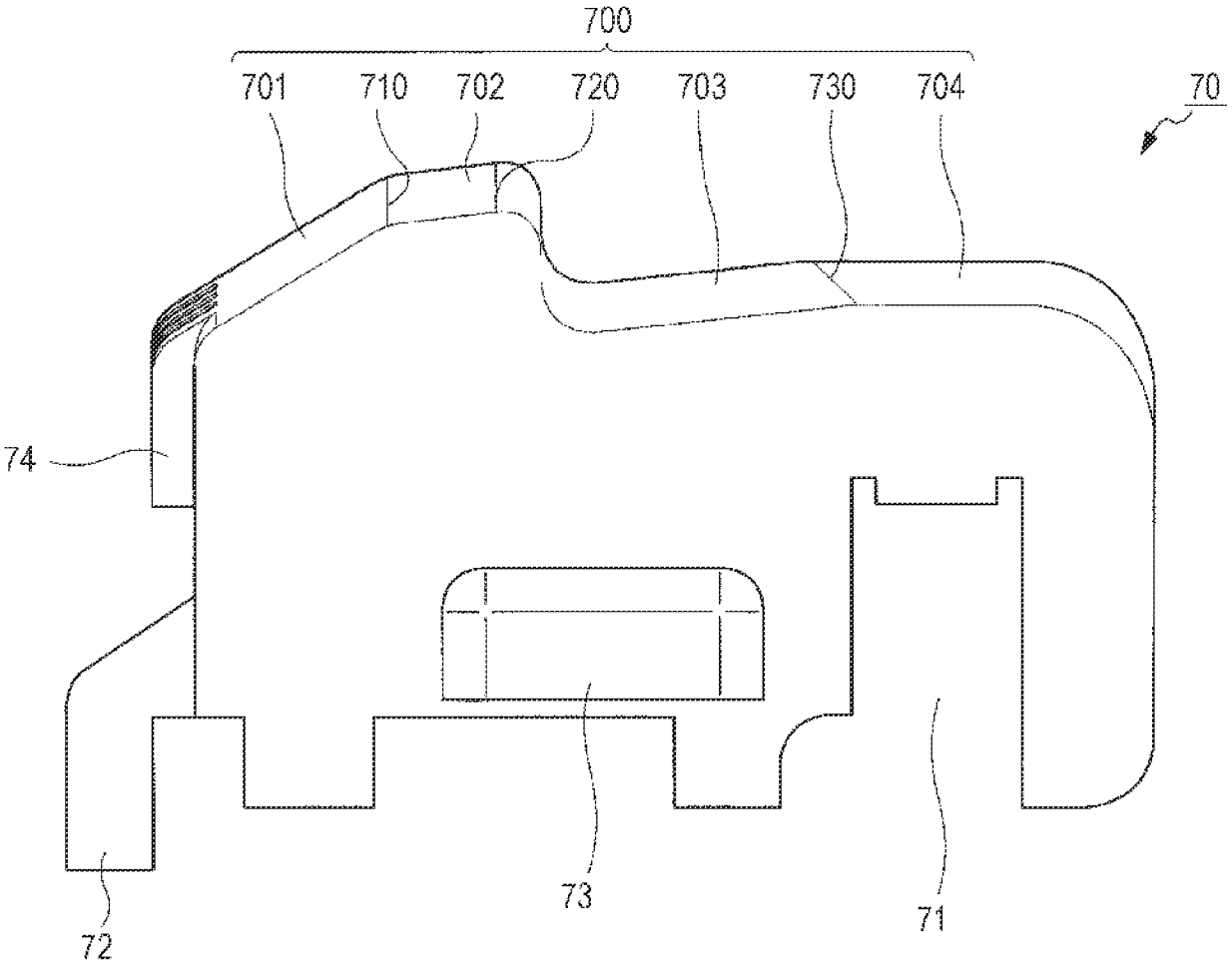
FIG. 9 is a side view of the presser component.
Figure 10A:
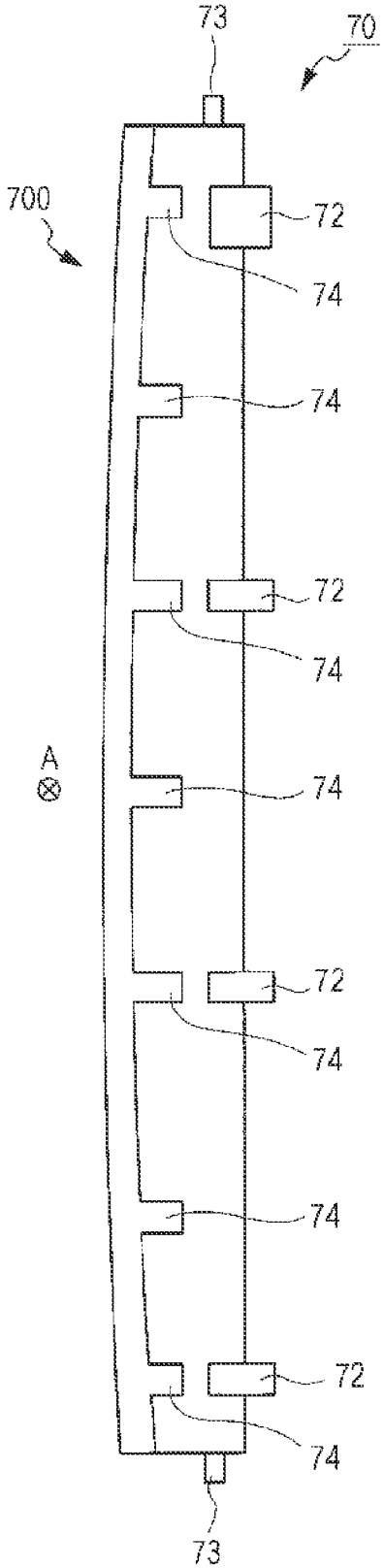
FIG. 10A is another side view of the presser component.
Figure 10B:
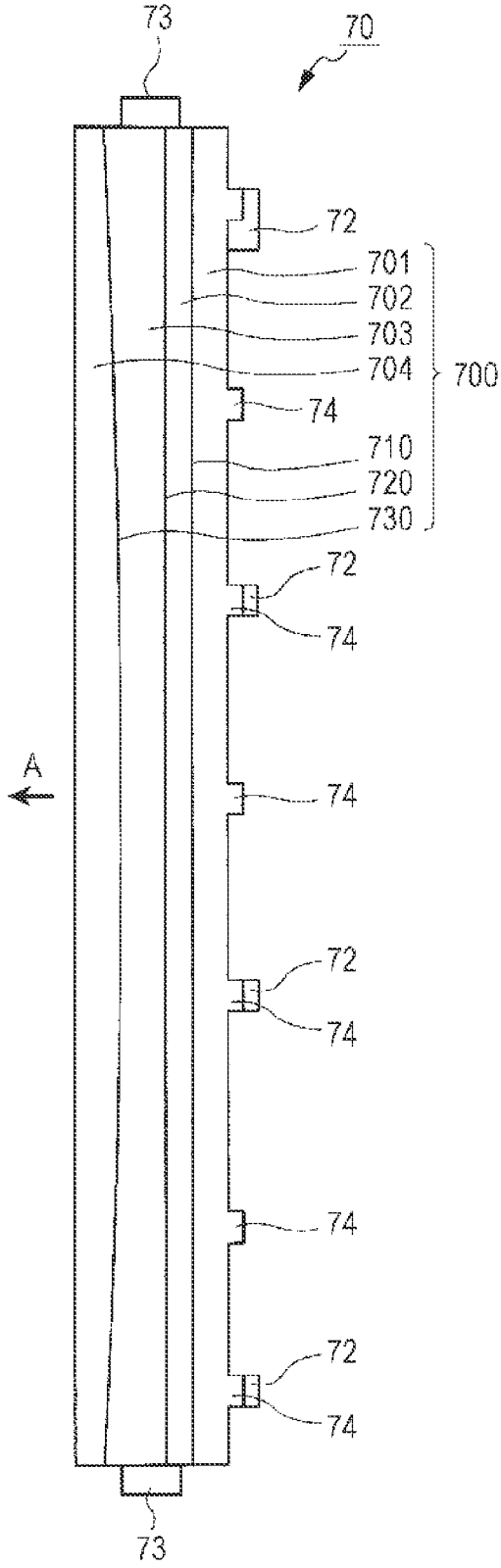
FIG. 10B is a top view of the presser component.

FIG. 8 is a perspective view of the presser component 70 of the pressure member 521. FIG. 9 is a side view of the presser component 70, as viewed from a direction indicated by an arrow IX in FIG. 8. FIG. 10A is a side view of the presser component 70, as viewed from a direction indicated by an arrow XA in FIG. 8. FIG. 10B is a top view of the presser component 70, as viewed from a direction indicated by an arrow XB in FIG. 8.

In FIG. 8, the lower left side is the front side when the presser component 70 is attached to the image forming apparatus 1, and the upper right side is the rear side when the presser component 70 is attached to the image forming apparatus 1. FIG. 9 is a side view of the rear side of the presser component 70, as viewed from the front side. In FIGS. 10A and 10B, the lower side is the front side when the presser component 70 is attached to the image forming apparatus 1, and the upper side is the rear side when the presser component 70 is attached to the image forming apparatus 1.

As described above, the presser component 70 according to this exemplary embodiment includes the single groove 71, the four hooks 72, the two protrusions 73, and the seven ribs 74. The presser component 70 is also provided with an opposing surface 700 that is to be disposed facing the inner peripheral surface of the pressure belt 520 when the pressure module 52 is formed.

In the following order from the upstream side in the transport direction A, the opposing surface 700 provided in the presser component 70 has a first opposing surface 701, a second opposing surface 702 following the first opposing surface 701, a third opposing surface 703 following the second opposing surface 702, and a fourth opposing surface 704 following the third opposing surface 703.

In the opposing surface 700 of the presser component 70, the first opposing surface 701 is a flat surface that extends downstream in the transport direction A from the ribs 74. The second opposing surface 702 is a flat surface that extends downstream in the transport direction A from a first ridge 710 serving as a boundary between the first opposing surface 701 and the second opposing surface 702. The third opposing surface 703 is a recessed surface that extends downstream in the transport direction A from a second ridge 720 serving as a boundary between the second opposing surface 702 and the third opposing surface 703. The fourth opposing surface 704 is constituted of a flat surface extending downstream in the transport direction A from a third ridge 730 serving as a boundary between the third opposing surface 703 and the fourth opposing surface 704 and a convex-curved surface extending downstream in the transport direction A from the flat surface. In this exemplary embodiment, the groove 71 for fitting the presser support component 80 (see FIG. 7) thereto is provided at the back side of the fourth opposing surface 704 of the presser component 70. As will be described later, the fourth opposing surface 704 is used for forming the fixation nip N (for example, see FIG. 4) between the heating roller 510 and the pressure belt 520.

In this exemplary embodiment, the opposing surface 700 as a whole, which includes the first opposing surface 701, the second opposing surface 702, the third opposing surface 703, and the fourth opposing surface 704, has, for example, a convex-curved shape that gradually bulges upward from the opposite ends to the central area of the presser component 70 in the axial direction, as shown in FIG. 10A. Furthermore, as shown in FIG. 10B, for example, of the first ridge 710, the second ridge 720, and the third ridge 730 formed in the opposing surface 700, the first ridge 710 and the second ridge 720 extend linearly in the axial direction of the presser component 70, whereas the third ridge 730 located at the downstream-most side in the transport direction A is curved such that the position of the ridge gradually shifts in the transport direction A from the central area toward the opposite ends of the presser component 70 in the axial direction. In other words, the third ridge 730 is formed into a convex-curved shape in the opposing surface 700 of the presser component 70, when viewed from the downstream side in the transport direction A.

In this exemplary embodiment, the second opposing surface 702 constitutes a first presser portion in the presser component 70. Furthermore, in this exemplary embodiment, the fourth opposing surface 704 constitutes a second presser portion in the presser component 70. Moreover, in this exemplary embodiment, the third opposing surface 703 constitutes a recess in the presser component 70.

Figure 11:
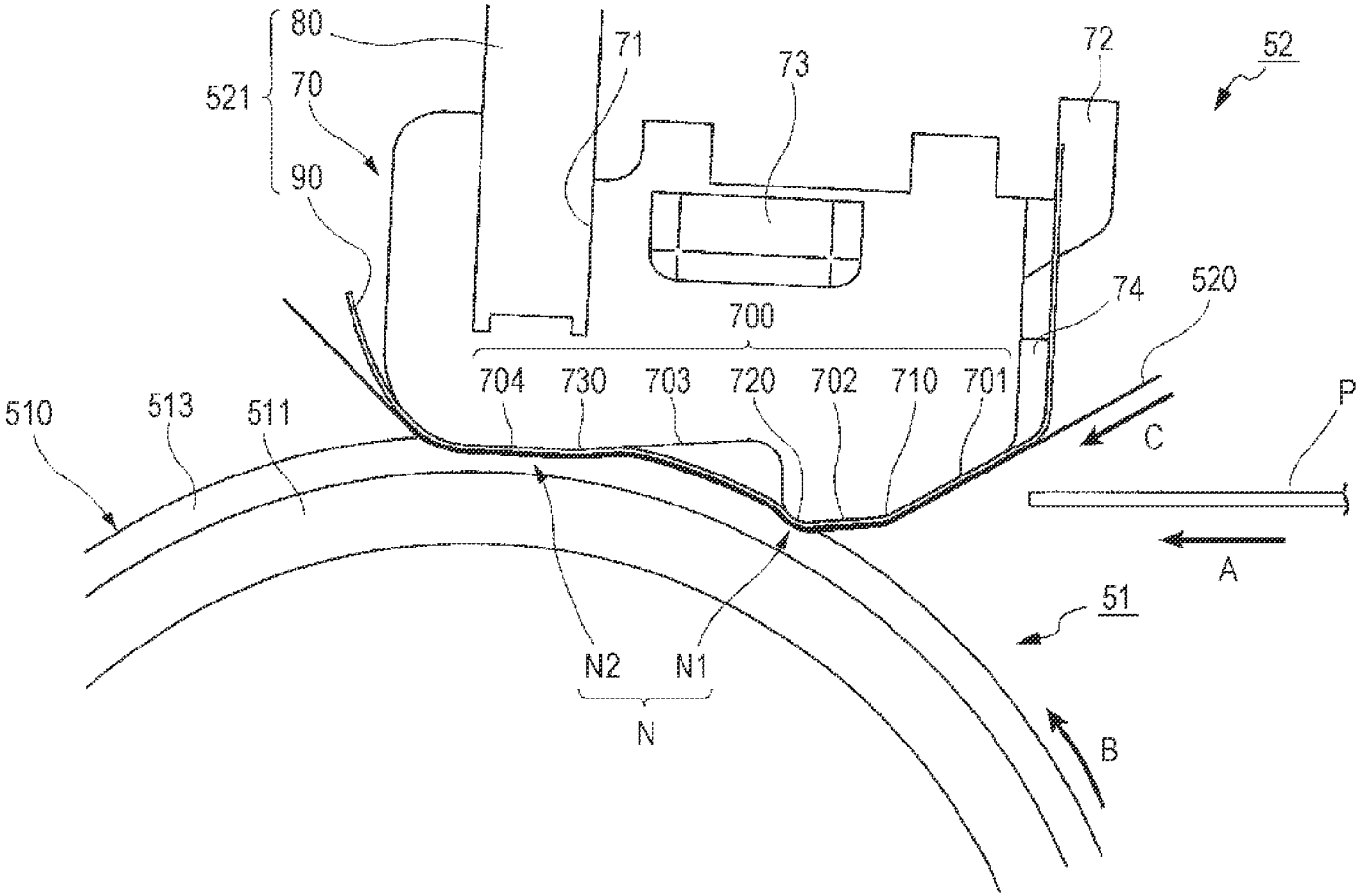
FIG. 11 is an enlarged side view of a fixation nip and a surrounding area thereof.
Figure 12:
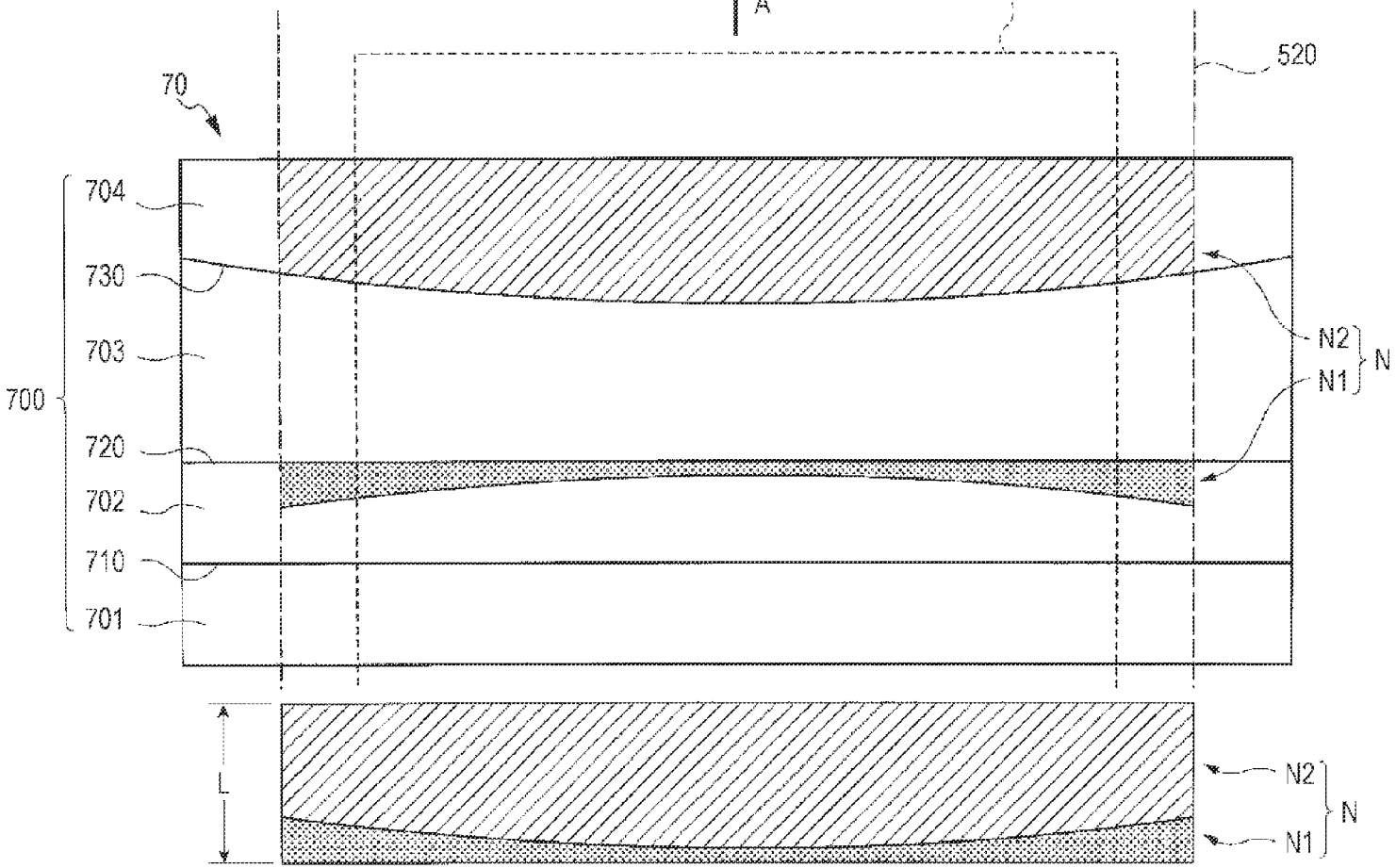
FIG. 12 is an enlarged top view of the fixation nip and the surrounding area thereof.

FIG. 11 is an enlarged side view of the fixation nip N and a surrounding area thereof in the fixing unit 500, as viewed from the front side (i.e., the near side in FIG. 4). FIG. 12 is an enlarged top view of the fixation nip N and the surrounding area thereof shown in FIG. 11, as viewed from the upper side in FIG. 11. Specifically, FIG. 11 illustrates an example of a state where the sheet P is not inserted into the fixation nip N yet, and FIG. 12 illustrates an example of a state where the sheet P is passing through the fixation nip N. In FIG. 12, the film component 90 that constitutes the pressure member 521 together with the presser component 70 and the presser support component 80 is not shown.

First, the relationship between the pressure belt 520 and the pressure member 521 (i.e., the presser component 70, the presser support component 80, and the film component 90) constituting the pressure module 52 in the area surrounding the fixation nip N will be described.

As described above, in this exemplary embodiment, the four openings 91 (see FIG. 7) arranged along one edge of the film component 90 are respectively attached to the four hooks 72 provided on the presser component 70, and the other edge of the film component 90 is disposed so as to cover the opposing surface 700 of the presser component 70 in the transport direction A. Therefore, the film component 90 is disposed between the opposing surface 700 of the presser component 70 and the inner peripheral surface of the pressure belt 520.

The pressure belt 520 rotating in the belt rotating direction C successively comes into contact with the first opposing surface 701 and the second opposing surface 702 via the film component 90, and then comes into contact with the fourth opposing surface 704 via the film component 90 after hardly coming into contact with the third opposing surface 703. An area of the pressure belt 520 that faces the third opposing surface 703 continues to be in contact with the film component 90, while the third opposing surface 703 and the film component 90 are not in contact with each other in actuality.

Furthermore, the pressure belt 520 rotating in the belt rotating direction C bends at the first ridge 710 and the second ridge 720 of the opposing surface 700, so that the moving direction of the pressure belt 520 changes after passing the first ridge 710 and the second ridge 720.

Furthermore, the presser support component 80 having the presser component 70 attached thereto presses the opposing surface 700 of the presser component 70 toward the heating roller 510 via the film component 90. In this case, in the opposing surface 700 of the presser component 70, the fourth opposing surface 704 located at the back side of the groove 71 receives a larger force than the other surfaces (i.e., the first opposing surface 701, the second opposing surface 702, and the third opposing surface 703) from the presser support component 80 attached to the groove 71.

Next, the relationship between the heating roller 510 constituting the heating module 51 and the pressure belt 520 constituting the pressure module 52 in the area surrounding the fixation nip N will be described below.

As described above, in this exemplary embodiment, the heating module 51 and the pressure module 52 are supported and positioned relative to each other by using the support module 53 (see FIG. 3). When performing this positioning, an area of the pressure belt 520 that faces the downstream edge of the second opposing surface 702 of the presser component 70 via the film component 90 and an area of the pressure belt 520 that faces the fourth opposing surface 704 of the presser component 70 via the film component 90 come into contact with the outer peripheral surface of the heating roller 510.

In this exemplary embodiment, the hardness of the presser component 70 is set to be higher than that of the cover member 513 constituting the heating roller 510. Therefore, the area of the pressure belt 520 that faces the downstream edge of the second opposing surface 702 via the film component 90 digs into contact with the cover member 513 of the heating roller 510, thereby forming a first fixation nip N1 (i.e., a dotted region in FIG. 12). Moreover, the area of the pressure belt 520 that faces the fourth opposing surface 704 via the film component 90 digs into contact with the cover member 513 of the heating roller 510, thereby forming a second fixation nip N2 (i.e., a hatched region in FIG. 12). Specifically, the fixation nip N in this exemplary embodiment includes the first fixation nip N1 located at the upstream side in the transport direction A and the second fixation nip N2 located at the downstream side of the first fixation nip N1 in the transport direction A.

In this exemplary embodiment, the shape of the fourth opposing surface 704 of the presser component 70 and the positional relationships among the heating roller 510, the pressure belt 520, and the presser component 70 are set such that the amount by which the pressure belt 520 digs into the cover member 513 at the downstream side of the second fixation nip N2 in the transport direction A (i.e., the exit side of the sheet P) is larger than the amount by which the pressure belt 520 digs into the cover member 513 at the upstream side of the second fixation nip N2 in the transport direction A (i.e., the entrance side of the sheet P). In this example, the upstream edge of the second fixation nip N2 in the transport direction A extends along the third ridge 730 of the opposing surface 700. Furthermore, in this example, FIG. 12 clearly shows that, for example, the opposite axial ends of the pressure belt 520 are positioned inward of the opposite axial ends of the presser component 70, and the opposite widthwise edges of the sheet P passing through the fixation nip N (i.e., the first fixation nip N1 and the second fixation nip N2) are positioned inward of the opposite axial ends of the pressure belt 520.

Next, the shapes of the first fixation nip N1 and the second fixation nip N2 constituting the fixation nip N and the relative relationship therebetween will be described below.

The first fixation nip N1 has a shape such that the length thereof in the transport direction A gradually decreases from the central area thereof toward the opposite ends thereof in the axial direction, which extends along the rotational axis of the heating roller 510. An upstream edge of the first fixation nip N1 in the transport direction A (i.e., the entrance side of the sheet P) has a central area that protrudes downstream in the transport direction A relative to the opposite axial ends thereof.

The second fixation nip N2 has a shape such that the length thereof in the transport direction A gradually increases from the central area thereof toward the opposite ends thereof in the axial direction, which extends along the rotational axis of the heating roller 510. An upstream edge of the second fixation nip N2 in the transport direction A (i.e., the entrance side of the sheet P) has a central area that protrudes upstream in the transport direction A relative to the opposite axial ends thereof.

In this exemplary embodiment, the first fixation nip N1 and the second fixation nip N2 have the above-described shapes so that the fixation nip N as a whole has the same nip length L, in the transport direction A, at any position in the axial direction, as shown in the lower section of FIG. 12.

In this exemplary embodiment, in addition to the aforementioned fixation nip N, an area of the pressure belt 520 that faces the third opposing surface 703 of the presser component 70 via the film component 90 also comes into contact with the outer peripheral surface of the heating roller 510. However, FIG. 11 clearly shows that this area is not pressed toward the heating roller 510 by the presser component 70 due to the existence of the third opposing surface 703 in the presser component 70.

The behavior of the sheet P passing through the fixation nip N will now be described. In this case, it is assumed that the heating roller 510 is already heated by the heater element 512 (see FIG. 4) and that the driven heating roller 510 is rotated in the roller rotating direction B, causing the pressure belt 520 coming into contact with the heating roller 510 at the fixation nip N to rotate in the belt rotating direction C due to the rotation of the heating roller 510.

The sheet P having the toner image second-transferred on one face thereof by traveling through the second-transfer device 30 (see FIG. 1) is transported in the transport direction A toward the fixing device 50. In this case, in the example shown in FIG. 11, the downward-facing face of the sheet P is the image-transferred face having the toner image transferred thereon.

Then, the leading edge of the sheet P transported in the transport direction A abuts on the area of the pressure belt 520, rotating in the belt rotating direction C, that faces the first opposing surface 701. When the leading edge of the sheet P abuts on the pressure belt 520, the leading edge of the sheet P is moved while being guided by the pressure belt 520 moving along the first opposing surface 701. After passing the area of the pressure belt 520 that faces the first ridge 710, the sheet P moves toward the heating roller 510 due to the resiliency of the sheet P. This causes the leading edge of the sheet P to abut on the outer peripheral surface of the heating roller 510 (the cover member 513 in actuality), rotating in the roller rotating direction B, at the upstream side of the first fixation nip N1 in the transport direction A. Subsequently, the image-transferred face of the sheet P starts to come into contact with the outer peripheral surface of the heating roller 510.

In this case, the heating roller 510 is heated by the heater element 512 (see FIG. 4) so that the toner existing in a region of the image-transferred face of the sheet P that is in contact with the outer peripheral surface of the heating roller 510 gradually begins to melt due to the heat received from the heating roller 510. As a result, the sheet P sticks to the outer peripheral surface of the heating roller 510 via the toner existing on the image-transferred face (i.e., the melted toner with increased viscosity).

Then, the leading edge of the sheet P transported while sequentially sticking to the heating roller 510 from the leading edge passes through the first fixation nip N1 between the heating roller 510 and the pressure belt 520 as the leading edge of the sheet P passes through the area facing the second opposing surface 702. Subsequently, the sheet P passes through the area facing the third opposing surface 703, and then passes through the second fixation nip N2 between the heating roller 510 and the pressure belt 520.

At the fixation nip N, namely, each of the first fixation nip N1 and the second fixation nip N2, the passing sheet P is heated by the heating roller 510 and is pressed by the presser component 70, whereby the toner image formed on the image-transferred face of the sheet P is fixed onto the sheet P. Furthermore, since the positional relationship between the heating roller 510 and the pressure belt 520 (i.e., the fourth opposing surface 704 of the presser component 70) at the second fixation nip N2 is set as shown in FIG. 11, the sheet P passing through the fixation nip N receives a larger force at the downstream side of the fixation nip N in the transport direction A than at the upstream side. Therefore, the sheet P is pressed with a large force toward the heating roller 510 (i.e., the cover member 513) at the downstream-most side of the fixation nip N, so that the leading edge of the sheet P passing through the fixation nip N receives a force acting in a direction away from the outer peripheral surface of the heating roller 510. As a result, the sheet P passing through the second fixation nip N2 after the fixing process is moved away (detached from) the outer peripheral surface of the heating roller 510 against the sticking force by the toner, so as to be transported toward the detecting piece 56 (see FIG. 2).

Furthermore, although the sheet P enters the second fixation nip N2 from the third ridge 730 in this example, the third ridge 730 in this exemplary embodiment has a convex-curved shape as viewed from the downstream side in the transport direction A, as shown in FIG. 12. Therefore, the leading edge of the sheet P entering the fixation nip N from the third ridge 730 passes through the third ridge 730 sequentially from the central area toward the opposite edges thereof in the width direction. Consequently, the sheet P passing through the third ridge 730 receives a force that pushes the sheet P outward of the opposite widthwise edges thereof from the central area toward the opposite edges in the widthwise direction. As a result, when the sheet P enters the second fixation nip N2 via the third ridge 730, the occurrence of creases in the sheet P caused by pressure applied thereto may be avoided.

Because the first fixation nip N1 and the second fixation nip N2 constituting the fixation nip N have the shapes shown in FIG. 12 in this example, the same nip length L is maintained at any widthwise position of the sheet P passing through the fixation nip N. Thus, a variation in the fixation state (such as glossiness) in the image may be reduced between, for example, the central area and the opposite edges of the sheet P in the width direction.

In the above description, the leading edge of the sheet P is first made to abut on the area of the pressure belt 520 that faces the first opposing surface 701. However, even if the leading edge of the sheet P is first made to abut on the area of the pressure belt 520 that faces the second opposing surface 702, the leading edge of the sheet P can still reach the heating roller 510 at the upstream side of the first fixation nip N1 in the transport direction A.

As described above, in this exemplary embodiment, the sheet P transported toward the fixation nip N is guided toward the heating roller 510 by using the pressure belt 520 moving along the first opposing surface 701 (or the second opposing surface 702) of the presser component 70. Thus, the sheet P transported toward the fixation nip N can come into contact with the heating roller 510 at the upstream side of the fixation nip N in the transport direction A. By bringing the sheet P into contact with the heating roller 510 at the upstream side of the fixation nip N in the transport direction A, the sheet P can be contact-heated by the heating roller 510 before the sheet P reaches the fixation nip N. By employing this configuration, the efficiency for supplying heat to the sheet P may be improved, as compared with a case where the sheet P is contact-heated only at the fixation nip N. More specifically, by employing the configuration according to this exemplary embodiment, if the same fixation performance is to be achieved, for example, if the calorific value of the heater element 512 is the same, the fixation rate (i.e., the moving rate of the sheet P traveling through the fixing device 50) may be increased. Moreover, for example, if the fixation rate is the same, the calorific value of the heater element 512 may be reduced.

Furthermore, in this exemplary embodiment, the second fixation nip N2 in the fixation nip N is given the shape shown in FIG. 12 so that the occurrence of creases in the sheet P output from the fixation nip N may be suppressed.

Moreover, in this exemplary embodiment, the first fixation nip N1 in the fixation nip N is given the shape shown in FIG. 12 so that the fixation nip N as a whole, which includes the first fixation nip N1 and the second fixation nip N2, may achieve a reduced variation in the nip length L in the width direction, thereby suppressing unevenness in the image on the sheet P output from the fixation nip N.

Furthermore, in this exemplary embodiment, the components for forming the first fixation nip N1 and the components for forming the second fixation nip N2 are included in the presser component 70, which is a single component. With this configuration, the configuration of the device may be simplified, as compared with a case where the components are separately provided.

In this exemplary embodiment, the film component 90, which has a low friction coefficient, is disposed between the opposing surface 700 of the presser component 70, which is fixed in position, and the inner peripheral surface of the pressure belt 520, which rotates in the belt rotating direction C. With this configuration, degradation due to abrasion of the presser component 70 and the pressure belt 520 caused by long-term use thereof may be suppressed, as compared with a case where the film component 90 is not provided.

Although the upstream edge of the second fixation nip N2 in the transport direction A is curved in this exemplary embodiment, the shape of the upstream edge is not limited to this shape. For example, the upstream edge may be constituted of two straight lines that are arranged in a V-shape.

Furthermore, although the upstream edge of the first fixation nip N1 in the transport direction A is curved in this exemplary embodiment, the exemplary embodiment is not limited to this configuration. Alternatively, for example, the downstream edge of the first fixation nip N1 in the transport direction A may be curved.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a heating roller;

a rotatable endless belt having an inner peripheral surface and an outer peripheral surface facing the heating roller;

a first presser portion provided within the inner peripheral surface of the endless belt and configured to press the outer peripheral surface of the endless belt onto the heating roller in an opposed area where the endless belt and the heating roller are opposed to each other so as to form a first fixation nip between the endless belt and the heating roller and through which a recording medium bearing an image passes; and a second presser portion provided within the inner peripheral surface of the endless belt and configured to press the outer peripheral surface of the endless belt onto the heating roller at a position, in the opposed area, downstream of the first fixation nip in a transport direction of the recording medium so as to form a second fixation nip through which the recording medium having passed through the first fixation nip passes, wherein the first fixation nip has a shape such that a length thereof in the transport direction increases from a central area thereof toward opposite ends thereof in an axial direction, which extends along a rotational axis of the heating roller, wherein the second fixation nip has a shape such that a length thereof in the transport direction decreases from a central area thereof toward opposite ends thereof in the axial direction, and an upstream edge of the second fixation nip in the transport direction has a shape such that the central area in the axial direction protrudes upstream in the transport direction relative to the opposite ends in the axial direction, and wherein a fixation nip comprising the first and second fixation nips has a same nip length in the transport direction along the axial direction.

2. An image forming apparatus comprising:

an image forming section configured to form an image on a recording medium; and a fixing device configured to fix the image formed on the recording medium by the image forming section onto the recording medium by heating and pressing the recording medium, wherein the fixing device includes a heating roller;

a rotatable endless belt having an inner peripheral surface and an outer peripheral surface facing the heating roller;

a first presser portion provided within the inner peripheral surface of the endless belt and configured to press the outer peripheral surface of the endless belt onto the heating roller in an opposed area where the endless belt and the heating roller are opposed to each other so as to form a first fixation nip between the endless belt and the heating roller and through which a recording medium bearing an image passes; and a second presser portion provided within the inner peripheral surface of the endless belt and configured to press the outer peripheral surface of the endless belt onto the heating roller at a position, in the opposed area, downstream of the first fixation nip in a transport direction of the recording medium so as to form a second fixation nip through which the recording medium having passed through the first fixation nip passes, wherein the first fixation nip has a shape such that a length thereof in the transport direction increases from a central area thereof toward opposite ends thereof in an axial direction, which extends along a rotational axis of the heating roller, and wherein the second fixation nip has a shape such that a length thereof in the transport direction decreases from a central area thereof toward opposite ends thereof in the axial direction, and an upstream edge of the second fixation nip in the transport direction has a shape such that the central area in the axial direction protrudes upstream in the transport direction relative to the opposite ends in the axial direction, wherein a fixation nip comprising the first and second fixation s has same nip length in the ransport direction along the axial direction.

* * * * *